US011382821B2

(12) United States Patent
Liang et al.

(10) Patent No.: US 11,382,821 B2
(45) Date of Patent: Jul. 12, 2022

(54) MOVABLE CARRIER

(71) Applicant: Wistron Corporation, New Taipei (TW)

(72) Inventors: Chen-Yi Liang, New Taipei (TW); Cheng-Hsing Liu, New Taipei (TW); Chien-Wei Chen, New Taipei (TW)

(73) Assignee: Wistron Corporation, New Taipei (TW)

( * ) Notice: Subject to any disclaimer, the term of this patent is extended or adjusted under 35 U.S.C. 154(b) by 834 days.

(21) Appl. No.: 16/262,918

(22) Filed: Jan. 31, 2019

(65) Prior Publication Data

US 2020/0146925 A1 May 14, 2020

(30) Foreign Application Priority Data

Nov. 8, 2018 (TW) ..... 107139597

(51) Int. Cl.
*A61G 5/00* (2006.01)
*A61H 3/04* (2006.01)

(52) U.S. Cl.
CPC ..... *A61H 3/04* (2013.01); *A61G 5/00* (2013.01); *A61H 2203/0406* (2013.01)

(58) Field of Classification Search
CPC ..... A61G 5/00
USPC ..... 280/250.1
See application file for complete search history.

(56) References Cited

U.S. PATENT DOCUMENTS

| | | | | |
|---|---|---|---|---|
| 7,815,209 | B2 * | 10/2010 | Porcheron | A61G 5/127 280/250.1 |
| 10,406,049 | B2 * | 9/2019 | Liang | A61H 3/04 |
| 10,765,586 | B2 * | 9/2020 | Liang | A61H 1/00 |
| 11,285,059 | B1 * | 3/2022 | Alexander | A61H 1/00 |
| 2020/0008990 | A1 * | 1/2020 | Harrison | B62K 5/025 |

FOREIGN PATENT DOCUMENTS

| | | |
|---|---|---|
| CN | 101647745 | 2/2010 |
| CN | 104739589 A | 7/2015 |

* cited by examiner

*Primary Examiner* — Jacob B Meyer
*Assistant Examiner* — Hosam Shabara
(74) *Attorney, Agent, or Firm* — Winston Hsu

(57) ABSTRACT

A movable carrier includes a main body, a first wheel, a driving module, a first support member, a second wheel, a seat, a first handle and two first switches. The first wheel is pivotally connected to the main body. The driving module is disposed in the main body. The first support member is connected to the driving module. The second wheel is pivotally connected to the first support member. The seat is disposed on the main body. The first handle is pivotally connected to the seat and has a trigger portion. The first switches are disposed on the seat. When the first handle rotates with respect to the seat and the trigger portion triggers the first switch, the driving module drives the first support member to rotate with respect to the main body, so as to increase or decrease a distance between the first wheel and the second wheel.

16 Claims, 20 Drawing Sheets

MOVABLE CARRIER

BACKGROUND OF THE DISCLOSURE

1. Field of the Disclosure

The disclosure relates to a movable carrier and, more particularly, to a movable carrier capable of changing a distance between wheels by rotating a handle.

2. Description of the Prior Art

A movable carrier (e.g. wheelchair, stroller, scooter, etc.) is a convenient transportation for assisting disabled people in moving. In general, most of the movable carriers are equipped with a front wheel and a rear wheel. Since a center-of-gravity position of the movable carrier is high, the distance between the front wheel and the rear wheel has to increase, so as to improve stability during the movement of the movable carrier. On the other hand, when the movable carrier moves within a narrow space, the distance between the front wheel and the rear wheel has to decrease, so as to reduce a rotation radius, such that the movable carrier does not run into a wall or an object within the narrow space. At present, the distance between the front wheel and the rear wheel of the conventional movable carrier is fixed and cannot be adjusted, such that the conventional movable carrier cannot satisfy the aforesaid two usage requirements at the same time.

SUMMARY OF THE DISCLOSURE

The disclosure provides a movable carrier capable of changing a distance between wheels by rotating a handle, so as to solve the aforesaid problems.

According to an embodiment of the disclosure, a movable carrier includes a main body, a first wheel, a driving module, a first support member, a second wheel, a seat, a first handle and two first switches. The first wheel is pivotally connected to the main body. The driving module is disposed in the main body. The first support member is connected to the driving module. The second wheel is pivotally connected to the first support member. The seat is disposed on the main body. The first handle is pivotally connected to the seat and the first handle has a trigger portion. The first switches are disposed on the seat and located within a rotation range of the first handle. When the first handle rotates with respect to the seat and the trigger portion triggers one of the first switches, the driving module drives the first support member to rotate with respect to the main body along a first direction, so as to increase a distance between the first wheel and the second wheel. When the first handle rotates with respect to the seat and the trigger portion triggers another one of the first switches, the driving module drives the first support member to rotate with respect to the main body along a second direction, so as to decrease the distance between the first wheel and the second wheel. The first direction is opposite to the second direction.

As mentioned in the above, a user can rotate the handle to decrease the distance between the wheels, such that the movable carrier can move within a narrow space by a small rotation radius. Furthermore, the user can rotate the handle to increase the distance between the wheels, so as to improve stability during the movement of the movable carrier. In other words, the user can rotate the handle to change the distance between the wheels, such that the movable carrier of the disclosure can satisfy different usage requirements.

These and other objectives of the present disclosure will no doubt become obvious to those of ordinary skill in the art after reading the following detailed description of the preferred embodiment that is illustrated in the various figures and drawings.

DETAILED DESCRIPTION

Figure 1:
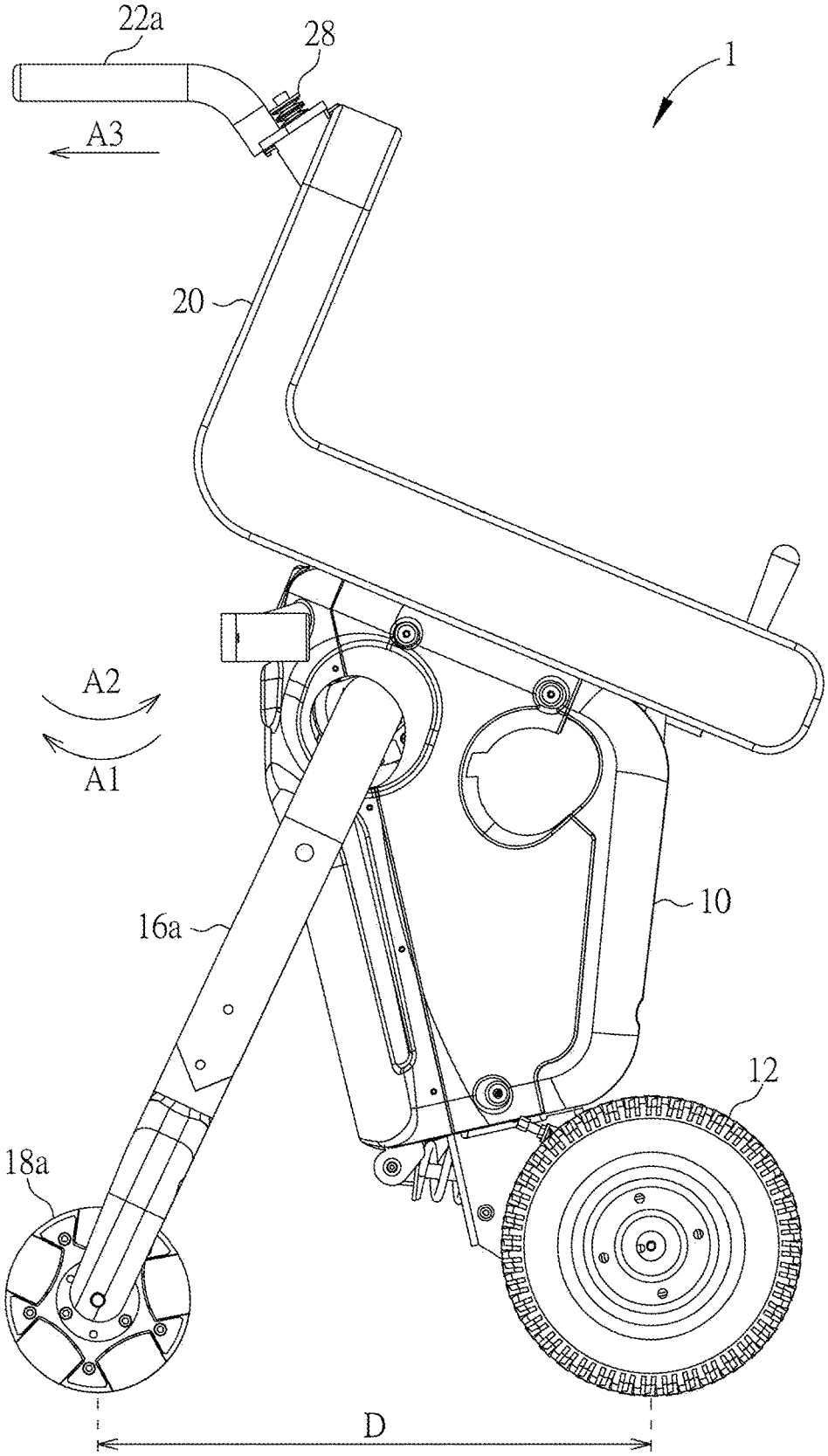
FIG. 1 is a side view illustrating a movable carrier according to an embodiment of the disclosure.

Referring to FIGS. 1 to 6, a movable carrier 1 includes a main body 10, a first wheel 12, a driving module 14, a first support member 16*a*, a second support member 16*b*, a second wheel 18*a*, a third wheel 18*b*, a seat 20, a first handle 22*a*, a second handle 22*b* and two first switches 24*a*, 24*b*. In this embodiment, the movable carrier 1 may be a wheelchair, a stroller, a scooter or other carriers according to practical applications.

Figure 3:
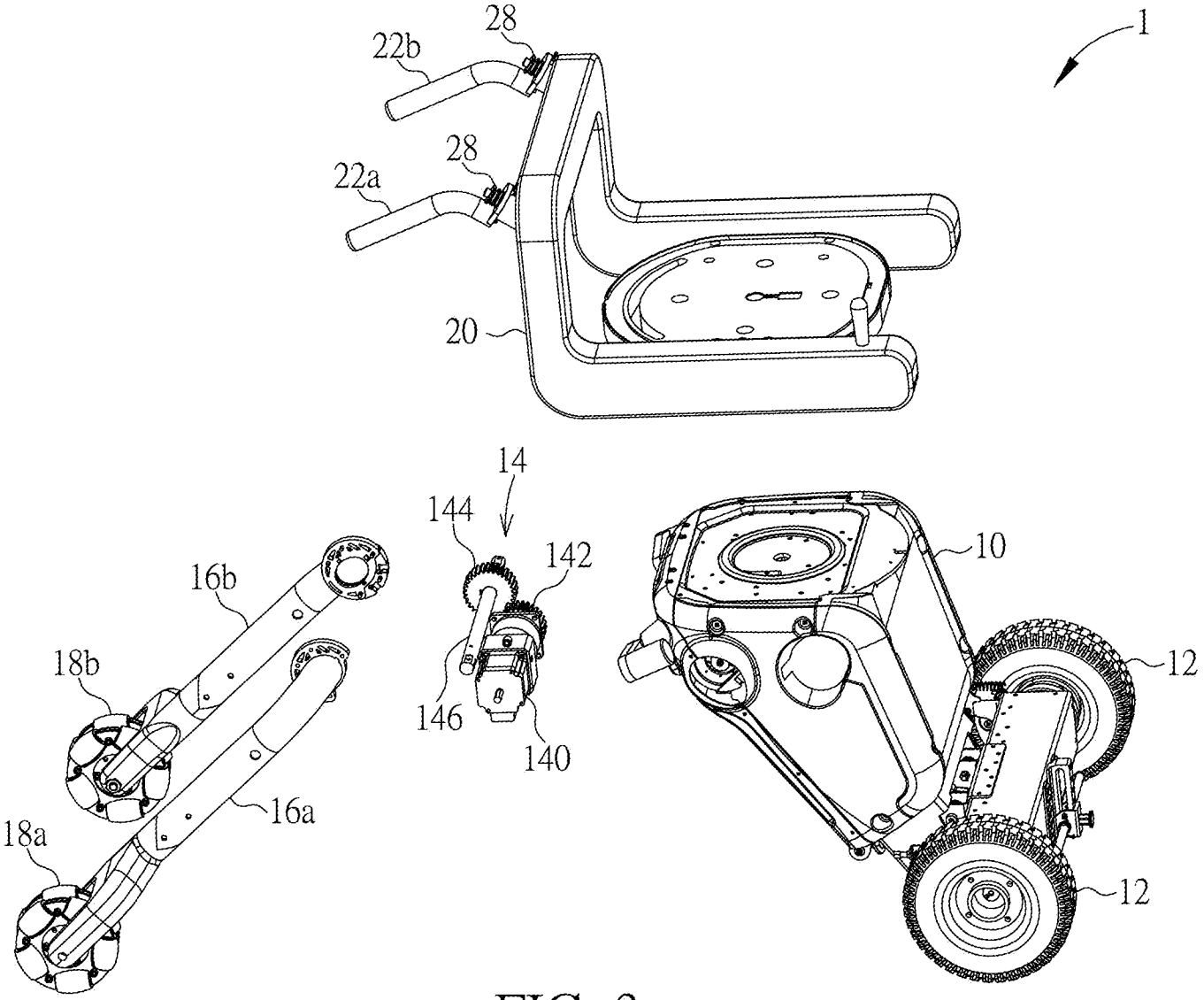
FIG. 3 is an exploded view illustrating the movable carrier shown in FIG. 1.
Figure 4:
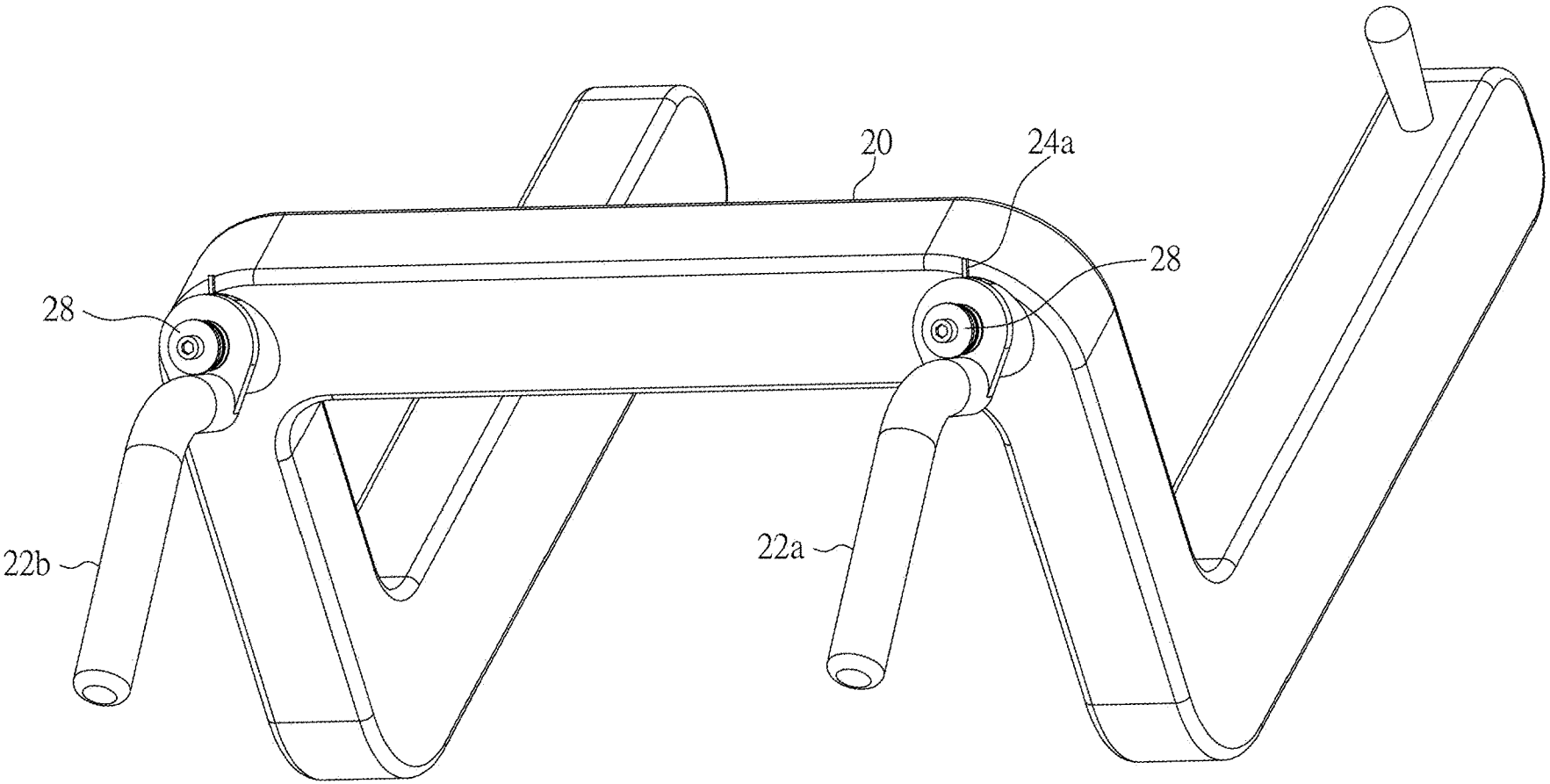
FIG. 4 is a perspective view illustrating a seat, a first handle and a second handle.
Figure 5:
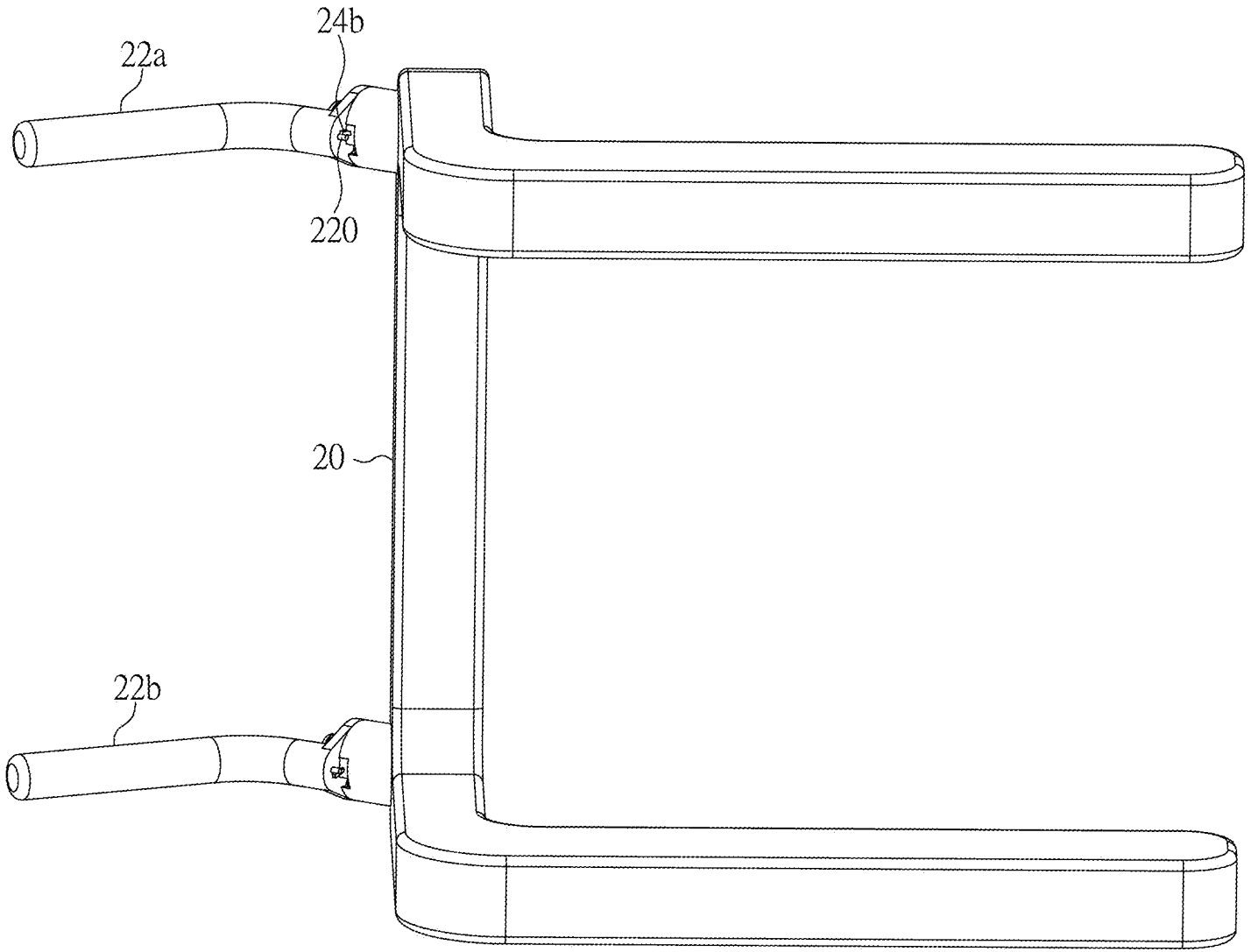
FIG. 5 is a perspective view illustrating the seat, the first handle and the second handle from another viewing angle.

The first wheel 12 is pivotally connected to the main body 10. As shown in FIG. 3, the movable carrier 1 may include two first wheels 12 pivotally connected to opposite sides of the main body 10. It should be noted that the number of the first wheels 12 may be one or more and the first wheel 12 may be connected to an appropriate portion of the main body 10, so the disclosure is not limited to the embodiment shown in the figure.

The driving module 14 is disposed in the main body 10. In this embodiment, the driving module 14 may include a first motor 140, a first gear 142, a second gear 144 and a link rod 146, wherein the first gear 142 is connected to the first motor 140, the second gear 144 is disposed on the link rod 146, and the first gear 142 meshes with the second gear 144. The first support member 16*a* and the second support member 16*b* are connected to opposite ends of the link rod 146 of the driving module 14. Accordingly, the first motor 140 can drive the first support member 16*a* and the second support member 16*b* to rotate with respect to the main body 10 synchronously through the first gear 142, the second gear 144 and the link rod 146. The second wheel 18*a* is pivotally connected to an end of the first support member 16*a* and the third wheel 18*b* is pivotally connected to an end of the second support member 16*b*.

The seat 20 is disposed on the main body 10. The first handle 22*a* and the second handle 22*b* are pivotally connected to opposite sides of the seat 20. The first handle 22*a* has a trigger portion 220. The first switches 24*a*, 24*b* are disposed on the seat 20 and located within a rotation range of the first handle 22*a*, wherein the rotation range of the first handle 22*a* may be, but not limited to, 180 degrees, as shown in FIGS. 1 and 2.

Figure 2:
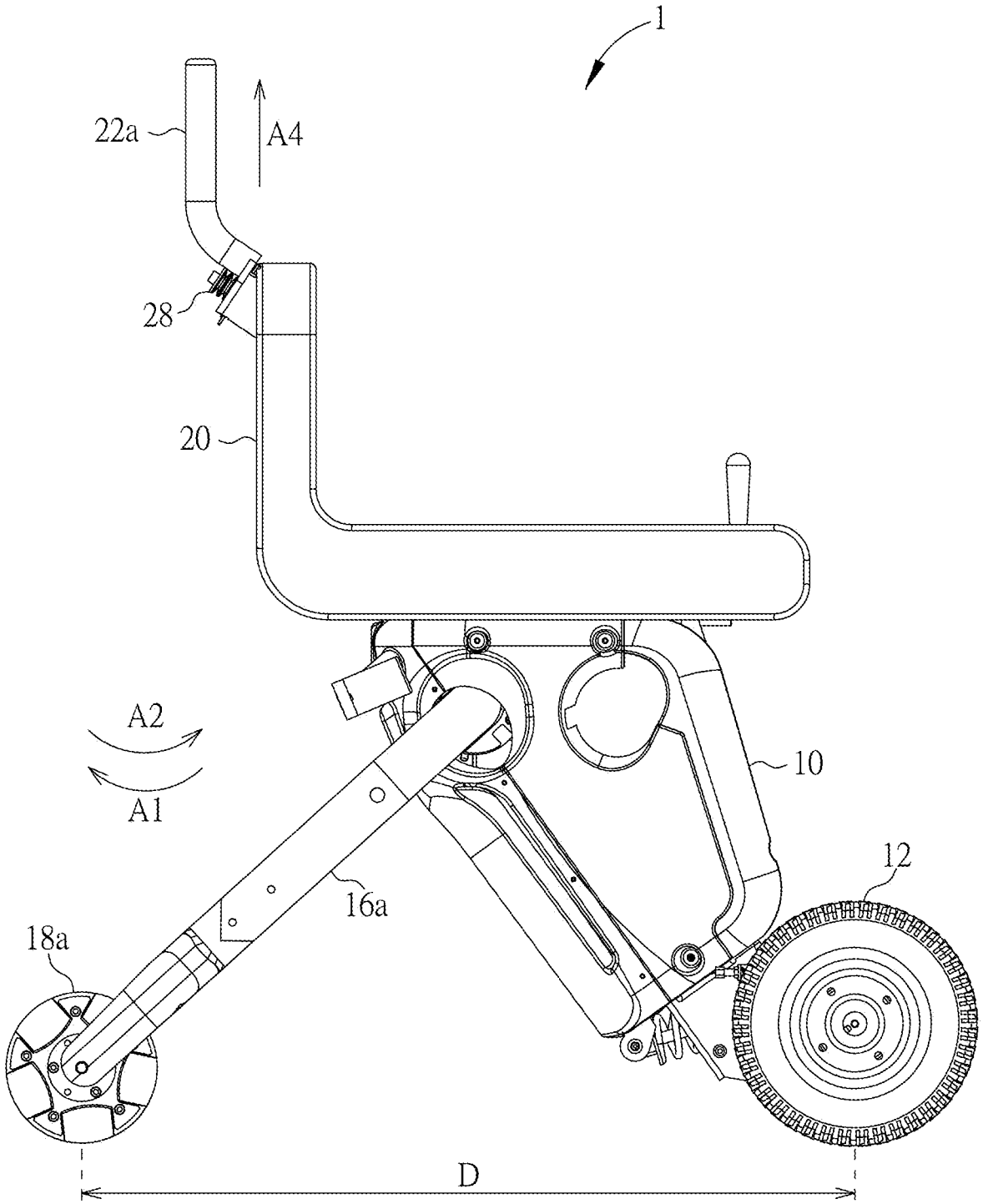
FIG. 2 is a side view illustrating the distance between the first wheel and the second wheel shown in FIG. 1 increases.

As shown in FIGS. 1 and 2, a user may rotate the first handle 22*a* to change a distance D between the first wheel 12 and the second wheel 18*a*. It should be noted that since the driving module 14 can drive the first support member 16*a* and the second support member 16*b* to rotate with respect to the main body 10 synchronously, the variation of the distance between the first wheel 12 and the third wheel 18*b* is identical to the variation of the distance D between the first wheel 12 and the second wheel 18*a*. In the following, the technical feature of the disclosure is illustrated by the variation of the distance D between the first wheel 12 and the second wheel 18*a*.

When the user wants to improve stability during the movement of the movable carrier 1, the user may rotate the first handle 22*a* shown in FIG. 1 to the position shown in FIG. 2. When the first handle 22*a* rotates with respect to the seat 20 to the position shown in FIG. 2 and the trigger portion 220 of the first handle 22*a* triggers the first switch 24*a*, the first motor 140 of the driving module 14 is actuated. Then, the first motor 140 drives the first support member 16*a* to rotate with respect to the main body 10 along a first direction A1 to the position shown in FIG. 2 through the first gear 142, the second gear 144 and the link rod 146, so as to increase the distance D between the first wheel 12 and the second wheel 18*a*. Accordingly, the stability during the movement of the movable carrier 1 can be improved.

When the user wants to move the movable carrier within a narrow space, the user may rotate the first handle 22*a* shown in FIG. 2 to the position shown in FIG. 1. When the first handle 22*a* rotates with respect to the seat 20 to the position shown in FIG. 1 and the trigger portion 220 of the first handle 22*a* triggers the first switch 24*b*, the first motor 140 of the driving module 14 is actuated. Then, the first motor 140 drives the first support member 16*a* to rotate with respect to the main body 10 along a second direction A2 to the position shown in FIG. 1 through the first gear 142, the second gear 144 and the link rod 146, so as to decrease the distance D between the first wheel 12 and the second wheel 18*a*. Accordingly, the movable carrier 1 can move within the narrow space by a small rotation radius, so as to prevent the movable carrier 1 from running into a wall or an object within the narrow space.

In this embodiment, when the first wheel 12 and the second wheel 18*a* are close to each other (as shown in FIG. 1), the first handle 22*a* may extend along a third direction A3; and when the first wheel 12 and the second wheel 18*a* are away from each other (as shown in FIG. 2), the first handle 22*a* may extend along a fourth direction A4, wherein the third direction A3 is perpendicular to the fourth direction A4. Accordingly, no matter which state shown in FIG. 1 or 2 the movable carrier 1 is situated at, the first handle 22*a* can be switched to a height appropriate for the user to grab and push the movable carrier 1. It should be noted that a random angle may be included between the third direction A3 and the fourth direction A4, so the third direction A3 is not limited to be perpendicular to the fourth direction A4.

Figure 6:
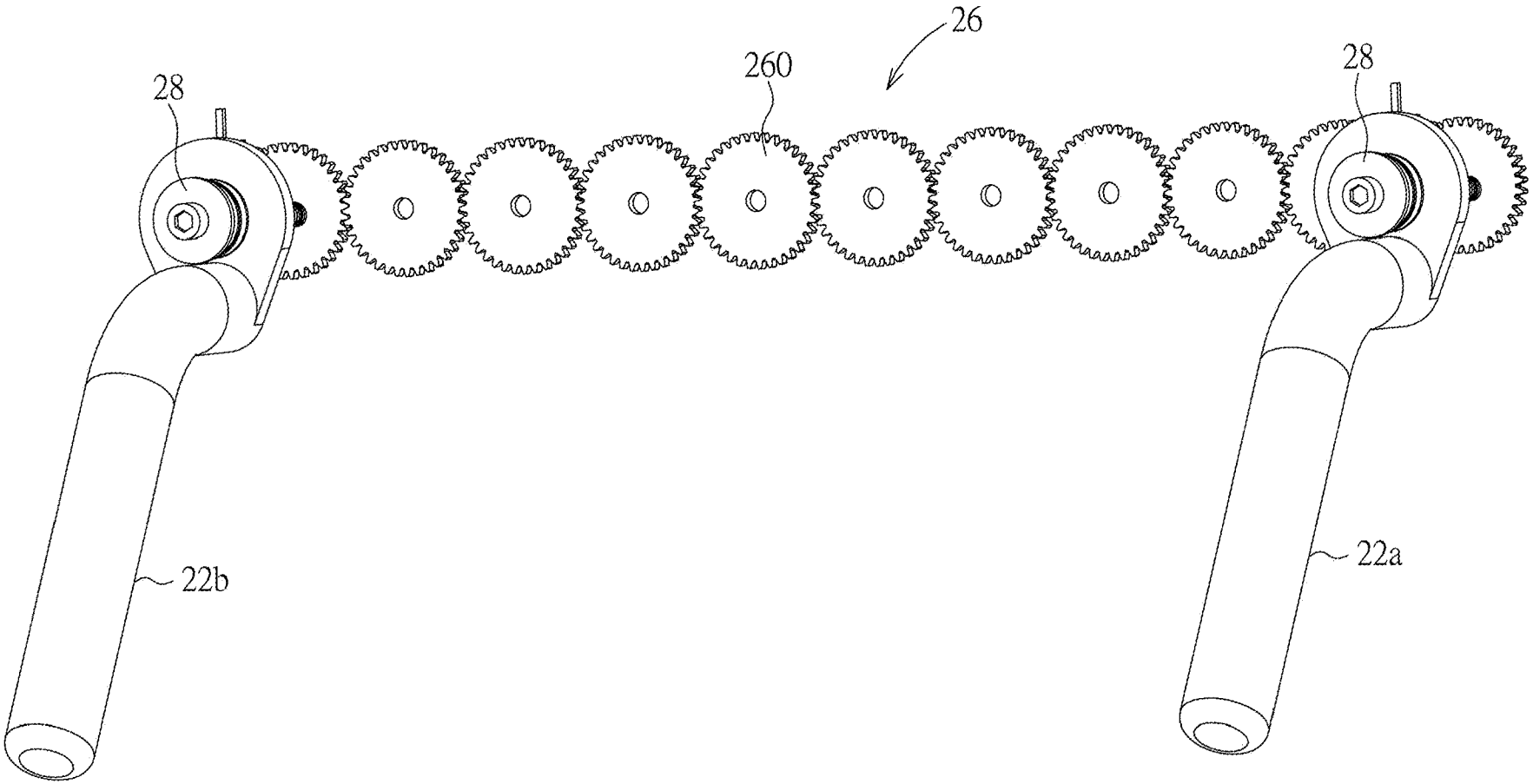
FIG. 6 is a perspective view illustrating the first handle, the second handle and a transmission mechanism.

Furthermore, the movable carrier 1 may further include a transmission mechanism 26 disposed in the seat 20 and connected to the first handle 22*a* and the second handle 22*b*. In this embodiment, the transmission mechanism 26 may include a plurality of gears 260 being meshed with each other, as shown in FIG. 6. The first handle 22*a* and the second handle 22*b* may be connected to two of the gears 260 (e.g. two outermost gears 260). Accordingly, when one of the first handle 22*a* and the second handle 22*b* rotates, the transmission mechanism 26 can drive the other one of the first handle 22*a* and the second handle 22*b* to rotate synchronously by the gears 260. It should be noted that since the transmission mechanism 26 can drive the first handle 22*a* and the second handle 22*b* to rotate synchronously, the user may rotate the second handle 22*b* to change the distance D between the first wheel 12 and the second wheel 18*a*.

Figure 7:
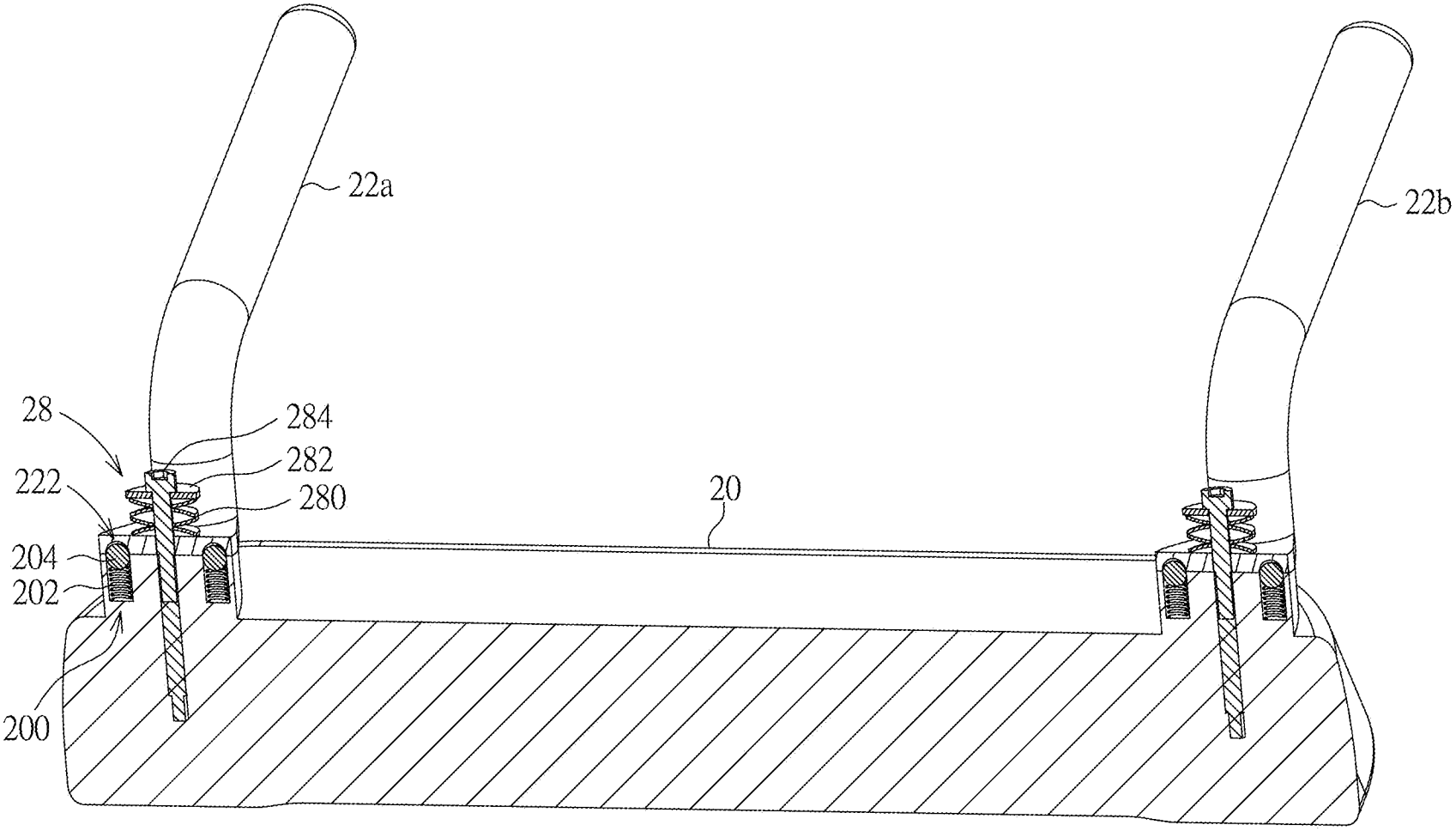
FIG. 7 is a sectional view illustrating the connection between the seat, the first handle and the second handle.
Figure 8:
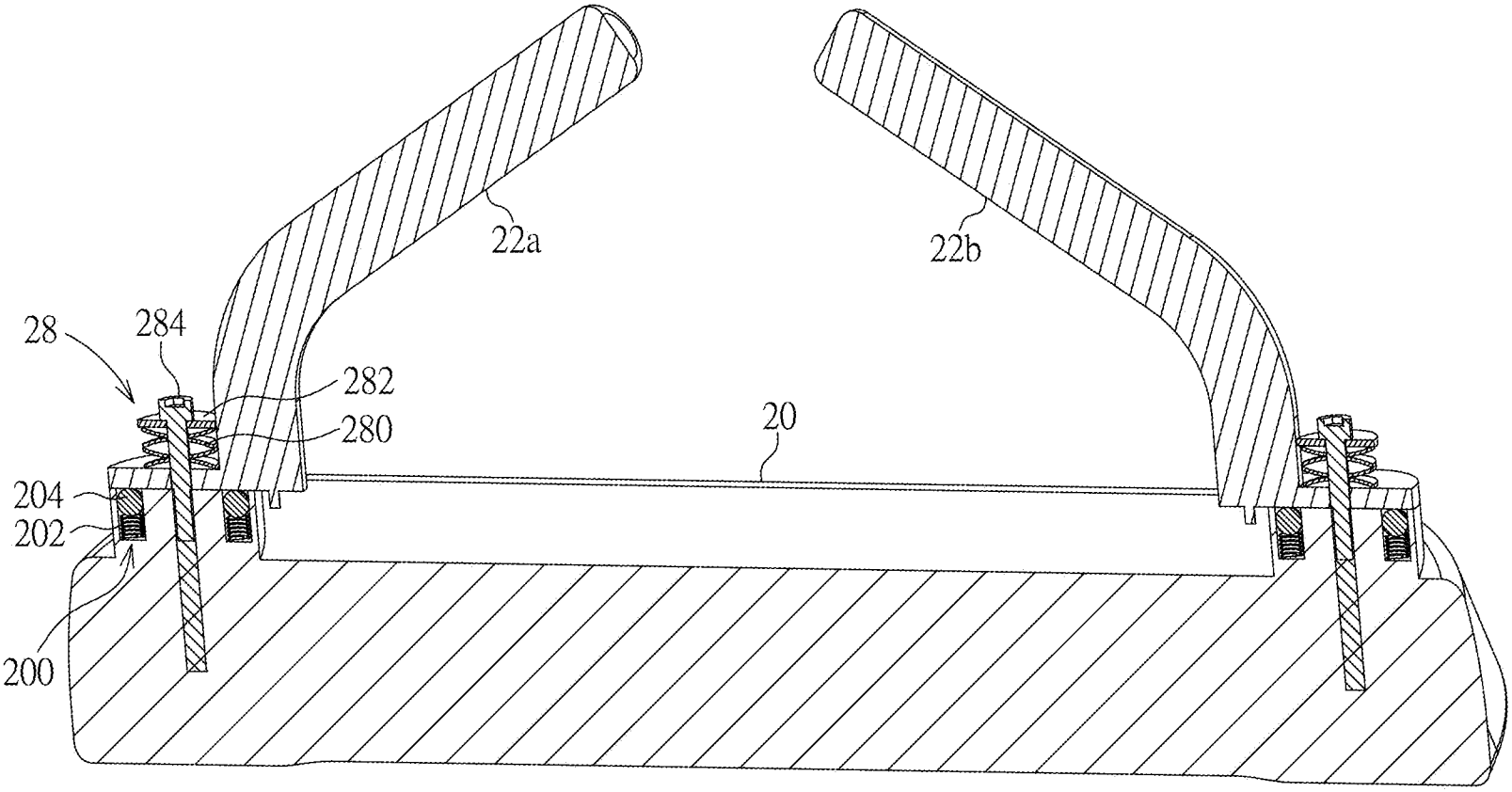
FIG. 8 is a sectional view illustrating the first handle and the second handle shown in FIG. 7 after rotation.

Referring to FIGS. 7 and 8, the first handle 22*a* and the second handle 22*b* may be pivotally connected to the seat 20 by a hinge 28. The arrangement of the hinge 28, the first handle 22*a* and the seat 20 is identical to the arrangement of the hinge 28, the second handle 22*b* and the seat 20. In the following, the technical feature of the disclosure is illustrated by the arrangement of the hinge 28, the first handle 22*a* and the seat 20.

The hinge 28 may include a disk spring 280, a plate member 282 and a fixing member 284. The disk spring 280 is sandwiched in between the plate member 282 and the first handle 22*a*, and the fixing member 284 passes through the plate member 282, the disk spring 280 and the first handle 22*a* to be connected to the seat 20. The disk spring 280 is used to provide torsion and the first handle 22*a* may rotate with respect to the seat 20 to any position. In this embodiment, the fixing member 284 may be a screw used to adjusting the torsion provided by the disk spring 280.

Furthermore, the first handle 22*a* has a plurality of positioning recesses 222 and the seat 20 has a plurality of accommodating recesses 200, a plurality of first elastic members 202 and a plurality of positioning members 204. In this embodiment, the first elastic member 202 may be a spring. The first elastic member 202 and the positioning member 204 are disposed in the accommodating recess 200, and opposite ends of the first elastic member 202 abut against a bottom of the accommodating recess 200 and the positioning member 204. As shown in FIG. 7, the positioning member 204 may engage with the positioning recess 222, so as to keep the first handle 22*a* motionless with respect to the seat 20. As shown in FIG. 8, when the first handle 22*a* rotates with respect to the seat 20, the positioning member 204 disengages from the positioning recess 222 and compresses the first elastic member 202. When the first handle 22*a* rotates with respect to the seat 20 continuously to align the positioning member 204 with the positioning recess 222, an elastic force provided by the first elastic member 202 may drive the positioning member 204 to return and to engage with the positioning recess 222. In other words, the disclosure may position the first handle 22*a* on the seat 20 by the cooperation between the positioning member 204 and the positioning recess 222.

Figure 9:
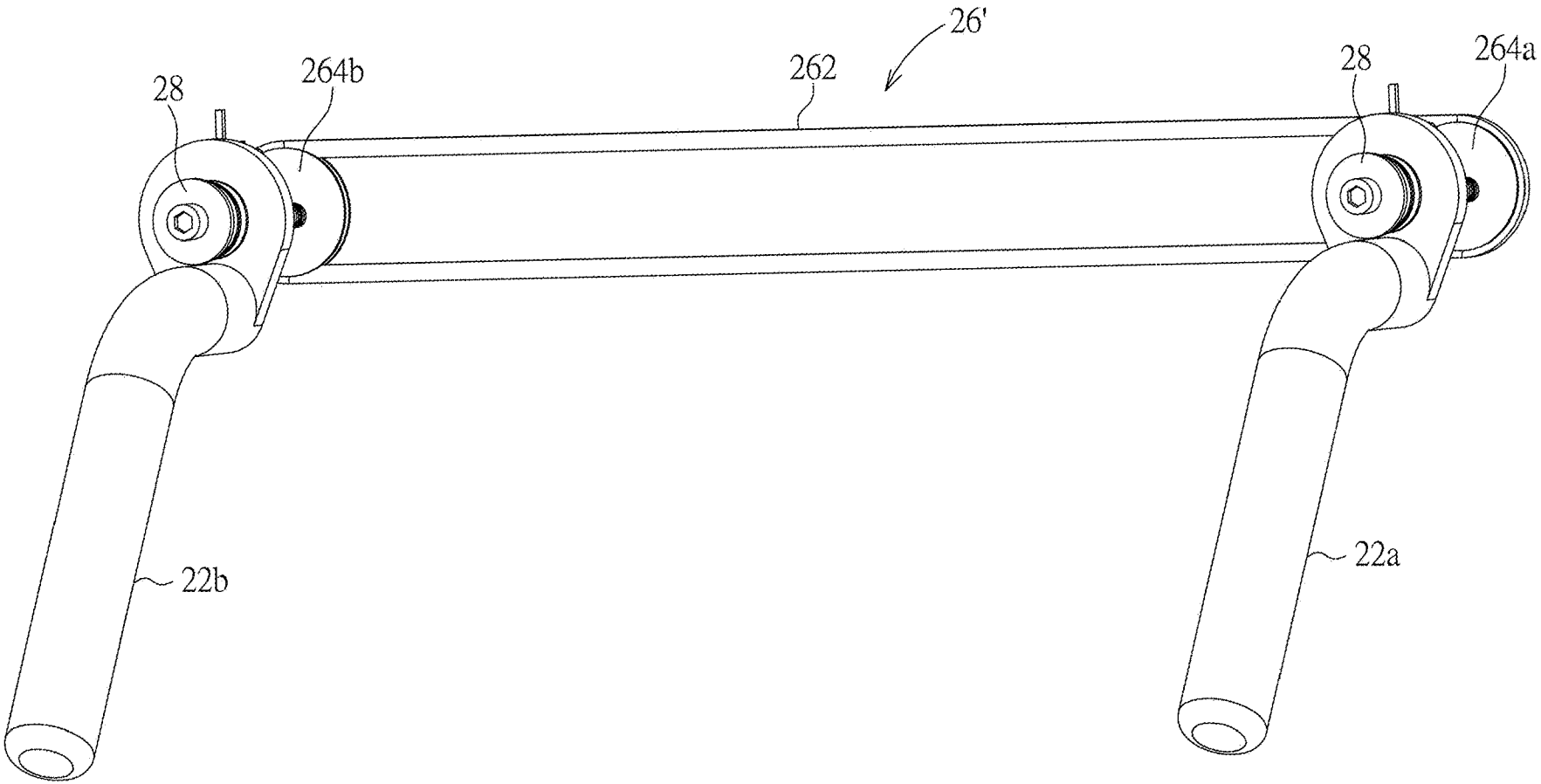
FIG. 9 is a perspective view illustrating a transmission mechanism according to another embodiment of the disclosure.

Referring to FIG. 9, the main difference between a transmission mechanism 26' shown in FIG. 9 and the aforesaid transmission mechanism 26 is that the transmission mechanism 26' includes a belt 262 and two pulleys 264*a*, 264*b*, wherein the pulleys 264*a*, 264*b* are connected to the first handle 22*a* and the second handle 22*b*, respectively, and the belt 262 is connected to the pulleys 264*a*, 264*b*. Accordingly, when one of the first handle 22*a* and the second handle 22*b* rotates, the transmission mechanism 26' can drive the other one of the first handle 22*a* and the second handle 22*b* to rotate synchronously by the belt 262 and the pulleys 264*a*, 264*b*.

Figure 10:
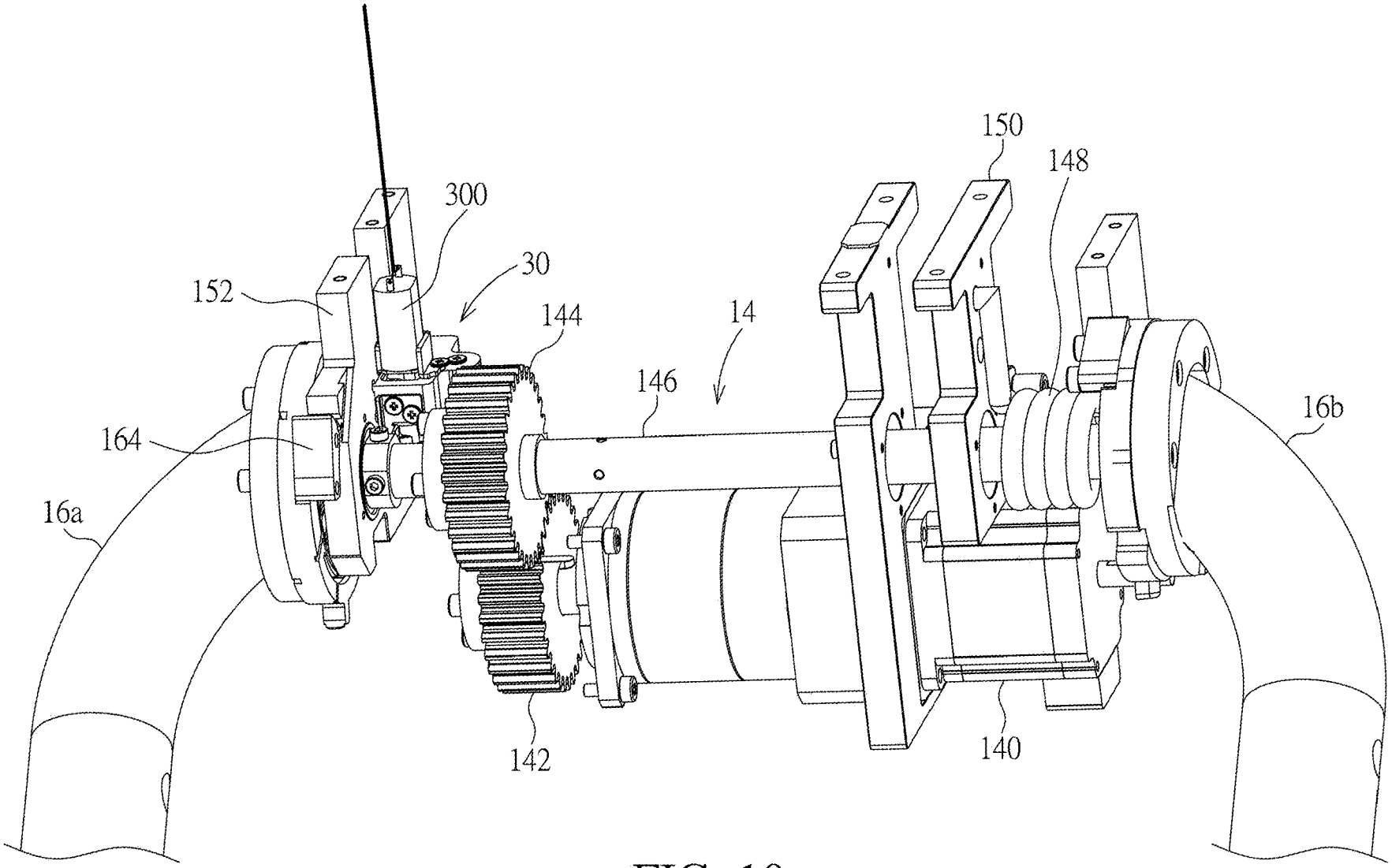
FIG. 10 is a perspective view illustrating a driving module according to another embodiment of the disclosure.

Referring to FIG. 10, according to another embodiment of the disclosure, the driving module 14 may further include a torsion spring 148 and a first fixing member 150. The torsion spring 148 and the first fixing member 150 are disposed on the link rod 146. Opposite ends of the torsion spring 148 are connected to the first fixing member 150 and the second support member 16*b*. By means of the torsion provided by the torsion spring 148, the torsion outputted by first motor 140 can be reduced effectively.

Figure 11:
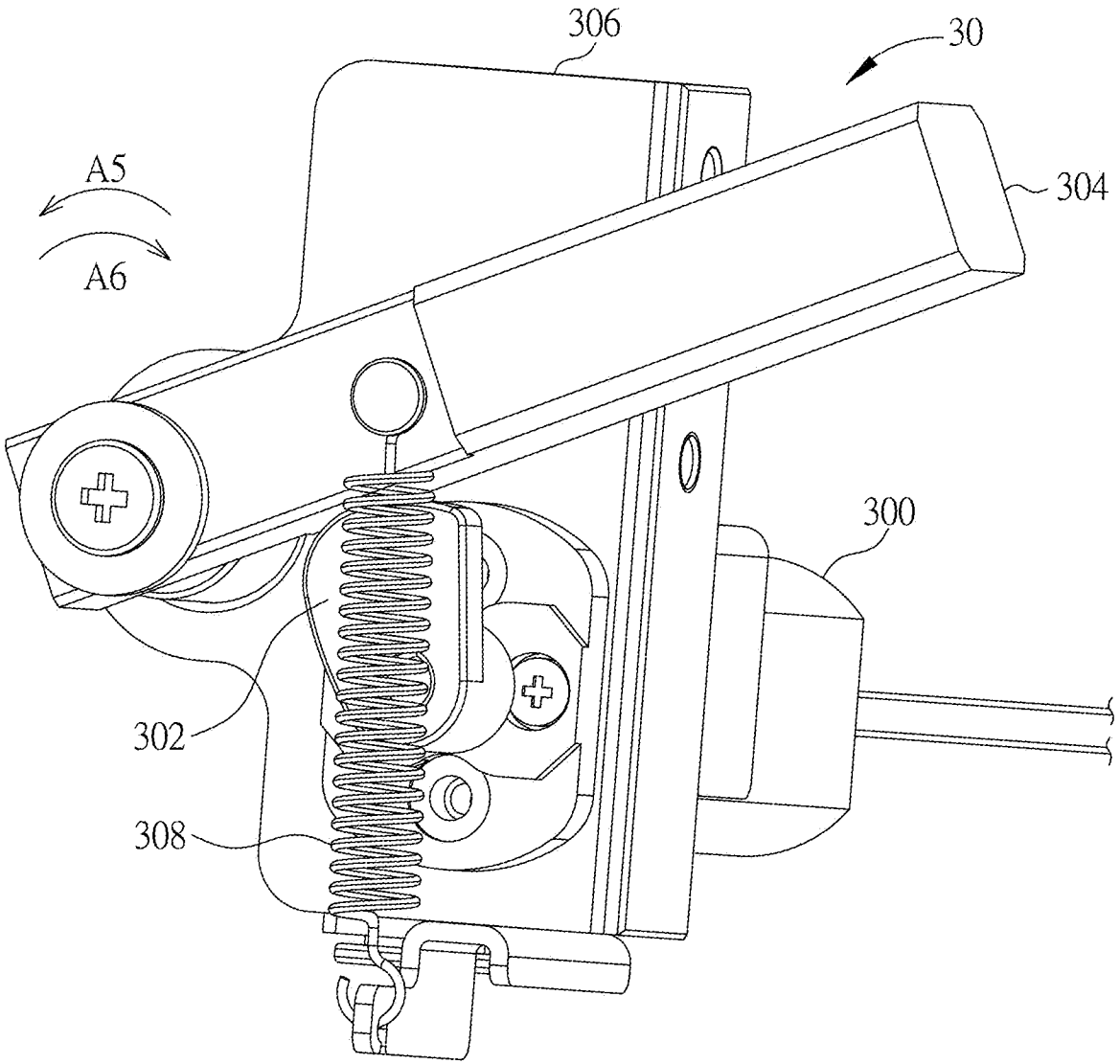
FIG. 11 is a perspective view illustrating a lock module according to another embodiment of the disclosure.
Figure 12:
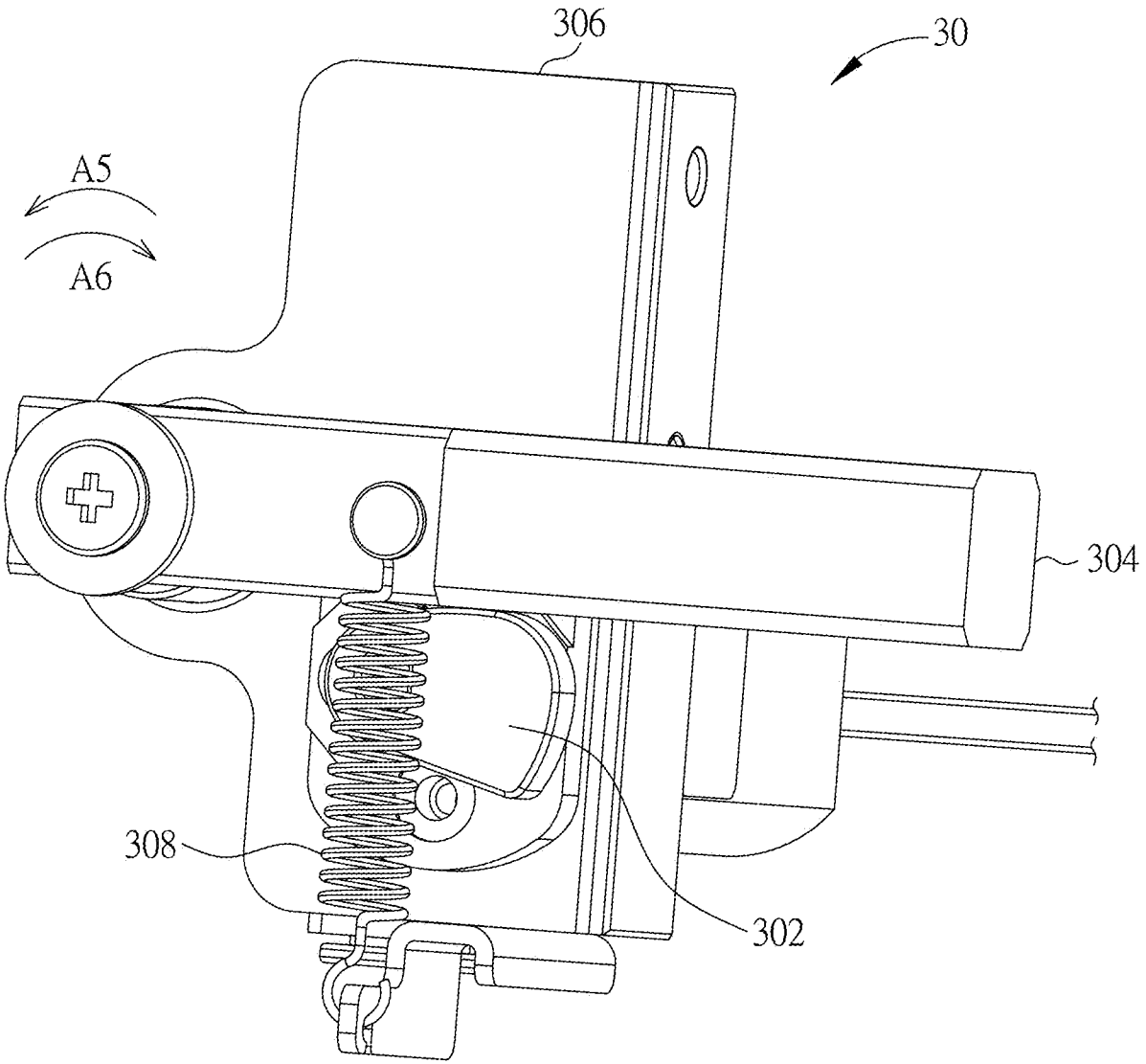
FIG. 12 is a perspective view illustrating a lock member shown in FIG. 11 after rotation.
Figure 13:
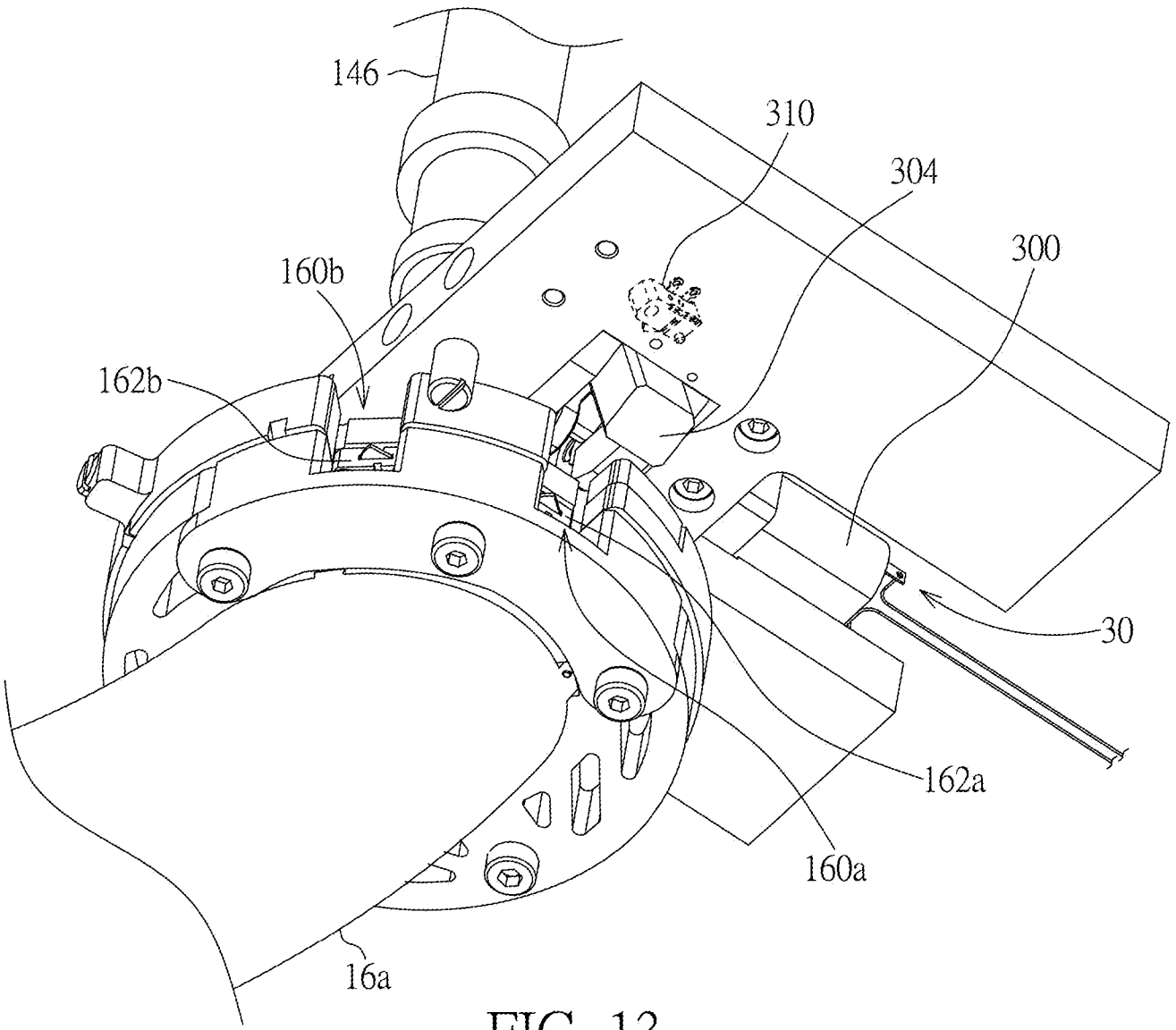
FIG. 13 is a perspective view illustrating the lock member disengaged from a lock recess.
Figure 14:
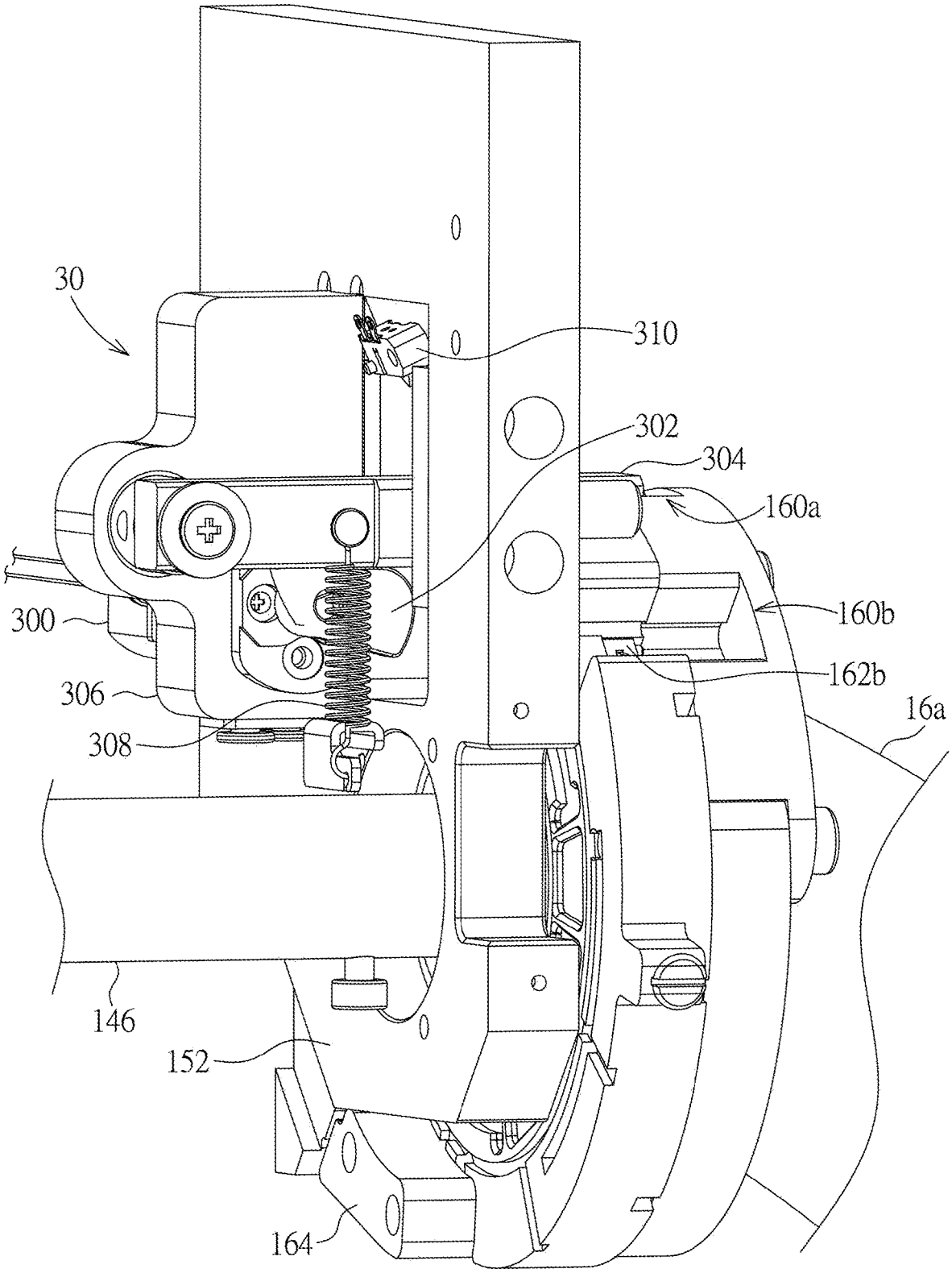
FIG. 14 is a perspective view illustrating the lock member engaged with the lock recess.
Figure 15:
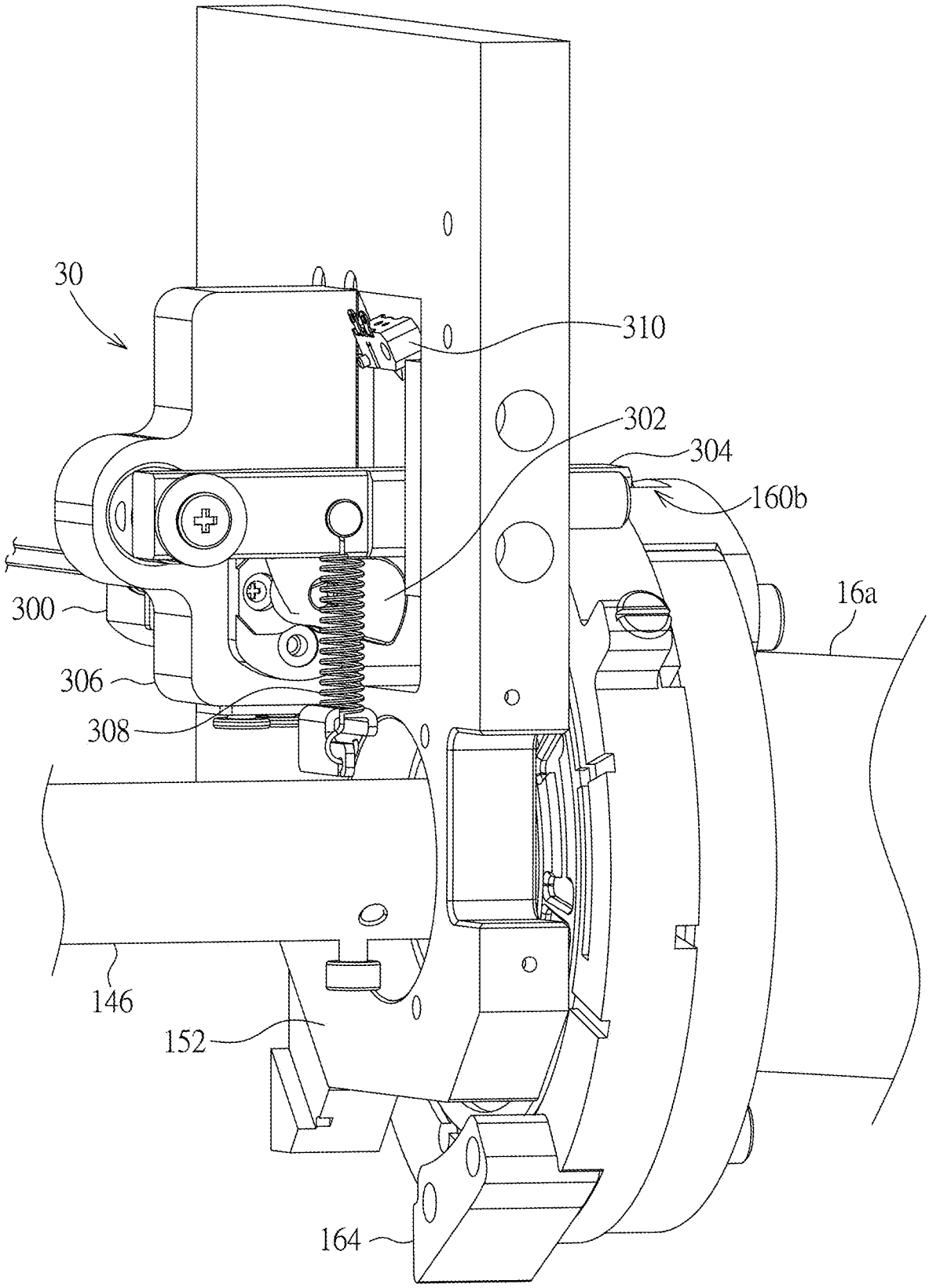
FIG. 15 is a perspective view illustrating the lock member engaged with another lock recess.

Referring to FIGS. 11 to 15, according to another embodiment of the disclosure, the aforesaid movable carrier 1 may further include a lock module 30. The lock module 30 includes a second motor 300, a cam 302, a lock member 304, a second fixing member 306, a second elastic member 308 and a second switch 310. As shown in FIGS. 11 and 12, the cam 302 is connected to the second motor 300, the lock member 304 is pivotally connected to the second fixing member 306, and opposite ends of the second elastic member 308 are connected to the lock member 304 and the second fixing member 306. In this embodiment, the second elastic member 308 may be a spring. As shown in FIGS. 13 to 15, the second switch 310 is disposed corresponding to the lock member 304. Furthermore, as shown in FIG. 13, the first support member 16*a* includes two lock recesses 160*a*, 160*b* and two third switches 162*a*, 162*b*, wherein the third switches 162*a*, 162*b* are disposed in the lock recesses 160*a*, 160*b*, respectively.

In this embodiment, the second motor 300 is used to drive the cam 302 to rotate and the cam 302 is used to drive the lock member 304 to rotate, such that the lock member 304 may disengage from or engage with one of the lock recesses 160*a*, 160*b*, so as to lock a rotation angle of the first support member 16*a*. When the lock member 304 engages with the lock recess 160*a* (as shown in FIG. 14), the first support member 16*a* is located at the position shown in FIG. 2. When the lock member 304 engages with the lock recess 160*b* (as shown in FIG. 15), the first support member 16*a* is located at the position shown in FIG. 1.

When the user wants to change the first support member 16*a* from the position shown in FIG. 2 to the position shown in FIG. 1, the user may rotate the first handle 22*a* shown in FIG. 2. Then, the second motor 300 is actuated to drive the cam 302 to rotate along a fifth direction A5 (as shown in FIG. 11). At this time, the cam 302 drives the lock member 304 to rotate along the fifth direction A5 (as shown in FIG. 11), such that the lock member 304 disengages from the lock recess 160*a* (as shown in FIG. 13) and the second elastic member 308 is stretched by the lock member 304 (as shown in FIG. 11). Then, when the lock member 304 triggers the second switch 310, the first motor 140 of the aforesaid driving module 14 is actuated to drive the first support member 16*a* to rotate from the position shown in FIG. 2 to the position shown in FIG. 1. It should be noted that when the lock member 304 triggers the second switch 310, the second motor 300 will stop for a predetermined time period (e.g. one second). After the lock member 304 moves out of a space above the lock recess 160*a*, the second motor 300 is actuated again to drive the cam 302 to rotate along the fifth direction A5 by a predetermined angle and then stops. After the cam 302 rotates, an elastic force provided by the second elastic member 308 pulls the lock member 304 along a sixth direction A6 (as shown in FIG. 12). After the cam 302 rotates along the fifth direction A5 by the predetermined angle, the lock member 304 disengages from the cam 302 and then the elastic force provided by the second elastic member 308 drives the lock member 304 to rotate along the sixth direction A6, such that the lock member 304 leans against the first support member 16*a*. When the first support member 16*a* rotates to the position shown in FIG. 15, the lock member 304 engages with the lock recess 160*b*, so as to lock the rotation angle of the first support member 16*a*. When the lock member 304 engages with the lock recess 160*b*, the lock member 304 triggers the third switch 162*b* in the lock recess 160*b*, such that the first motor 140 of the driving module 14 stops. Similarly, when the lock member 304 engages with the lock recess 160*a* and triggers the third switch 162*a*, the first motor 140 of the driving module 14 also stops. In other words, an embodiment of the disclosure may use the second switch 310 and the third switches 162*a*, 162*b* to control the first motor 140 of the driving module 14.

As shown in FIGS. 14 and 15, the driving module 14 may further include a stop member 152, and the first support member 16*a* may have a stop portion 164. The stop member 152 is disposed on the link rod 146. After the first motor 140 of the driving module 14 drives the first support member 16*a* to rotate with respect to the main body 10 along the first direction A1 to the position shown in FIG. 2, the stop member 152 stops the stop portion 164 to restrain the rotation angle of the first support member 16*a*. Accordingly, when a person is seated on the seat 20 shown in FIG. 2, the stop member 152 and the stop portion 164 can cooperate with each other to assist in supporting the weight of the person. Furthermore, the stop member 152 and the stop portion 164 can cooperate with each other to prevent the lock member 304 from being stuck in the lock recess 160*a* due to over rotation of the first support member 16*a*.

Figure 16:
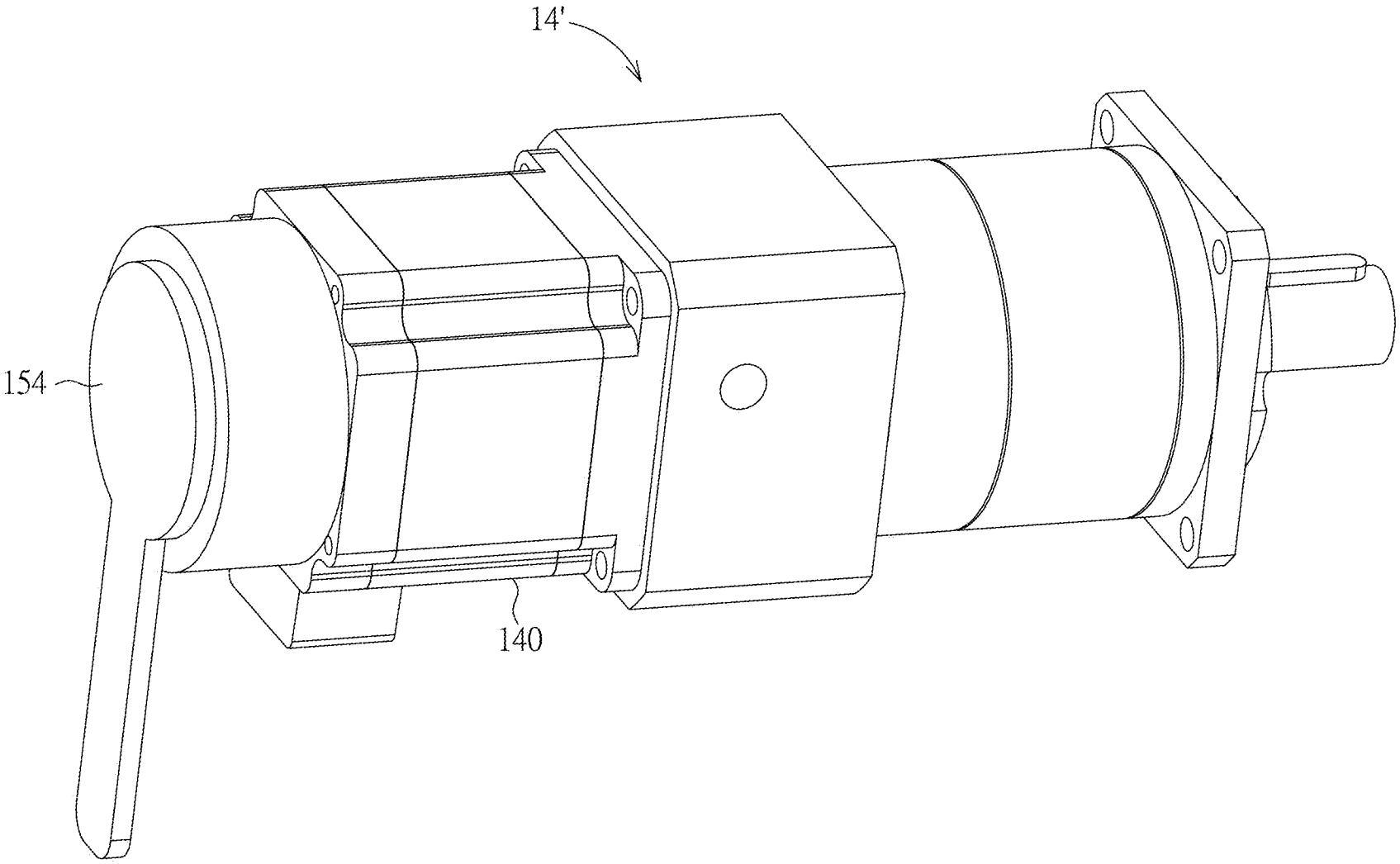
FIG. 16 is a perspective view illustrating a driving module according to another embodiment of the disclosure.

Referring to FIG. 16, the main difference between a driving module 14' shown in FIG. 16 and the aforesaid driving module 14 is that the driving module 14' further includes an electromagnetic brake 154 connected to the first motor 140. When the aforesaid driving module 14 is replaced by the driving module 14', the driving module 14' may stop the first motor 140 at any angle by the electromagnetic brake 154, so as to lock the rotation angle of the first support member 16*a*.

Figure 17:
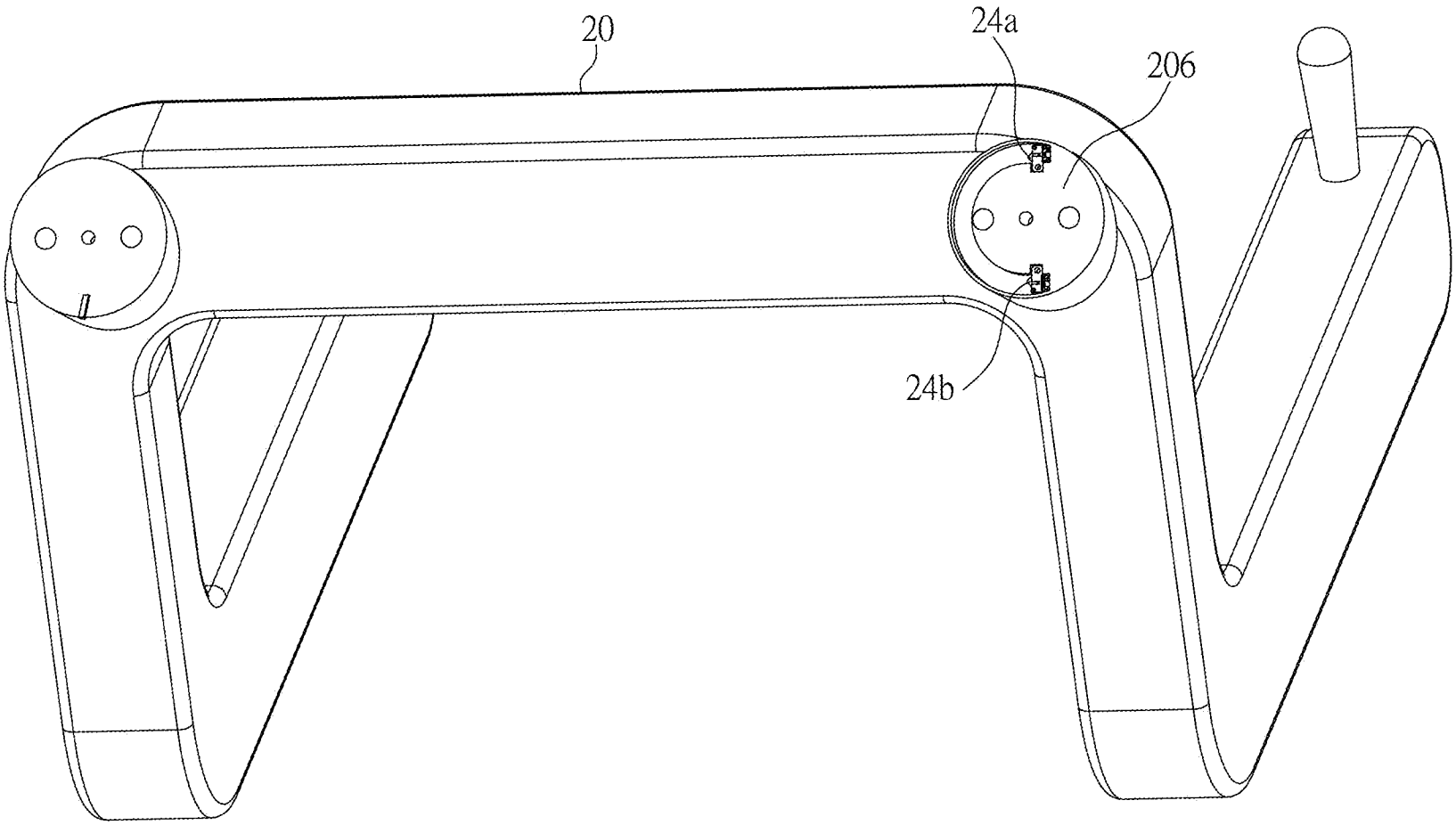
FIG. 17 is a perspective view illustrating a seat according to another embodiment of the disclosure.

Referring to FIG. 17, in another embodiment of the disclosure, the first switches 24*a*, 24*b* may also be disposed in a pivot portion 206 of the seat 20. When the aforesaid first handle 22*a* is pivotally connected to the pivot portion 206, the first switches 24*a*, 24*b* are hidden between the first handle 22*a* and the pivot portion 206.

Figure 18:
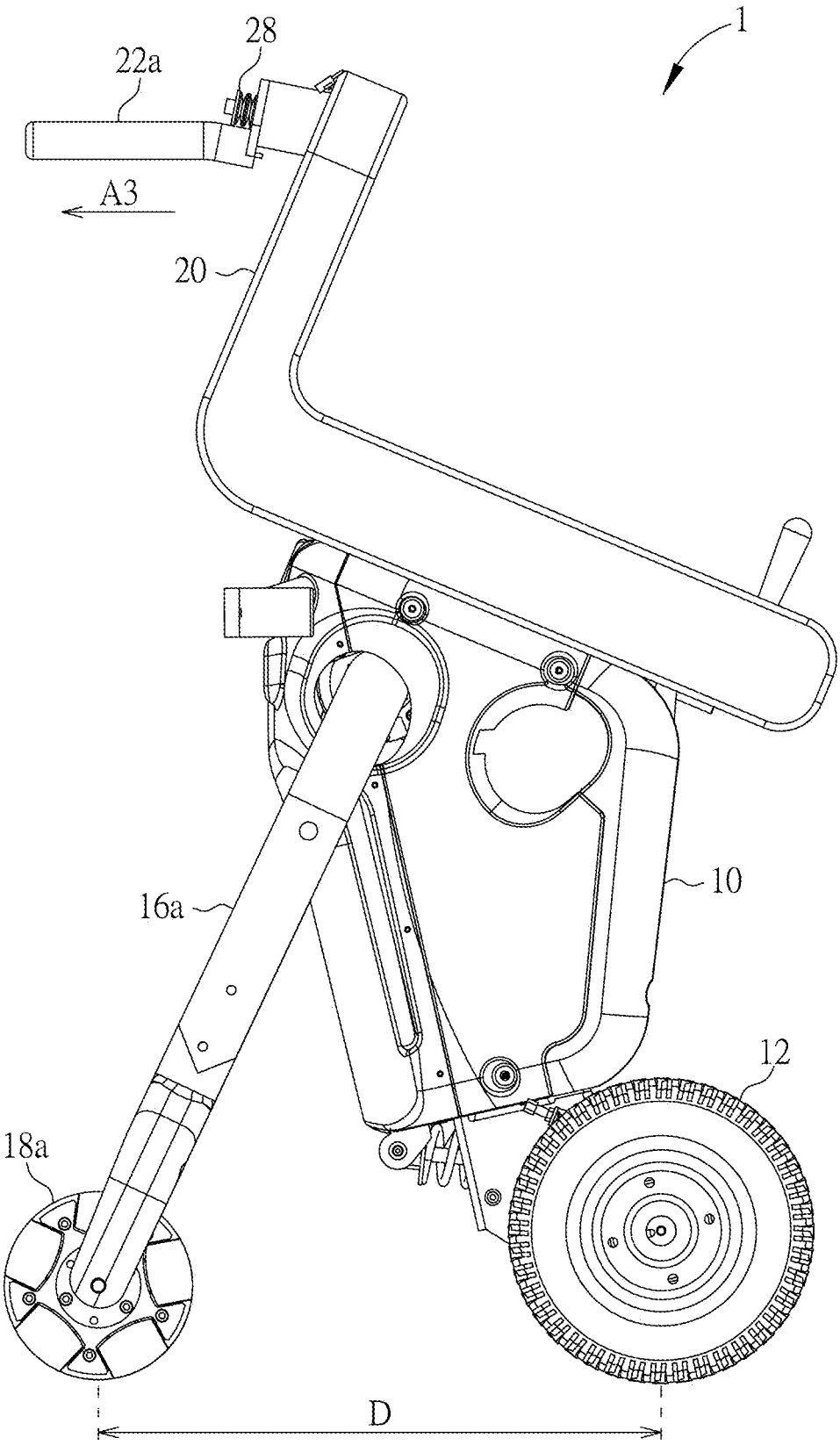
FIG. 18 is a side view illustrating a movable carrier according to another embodiment of the disclosure.
Figure 19:
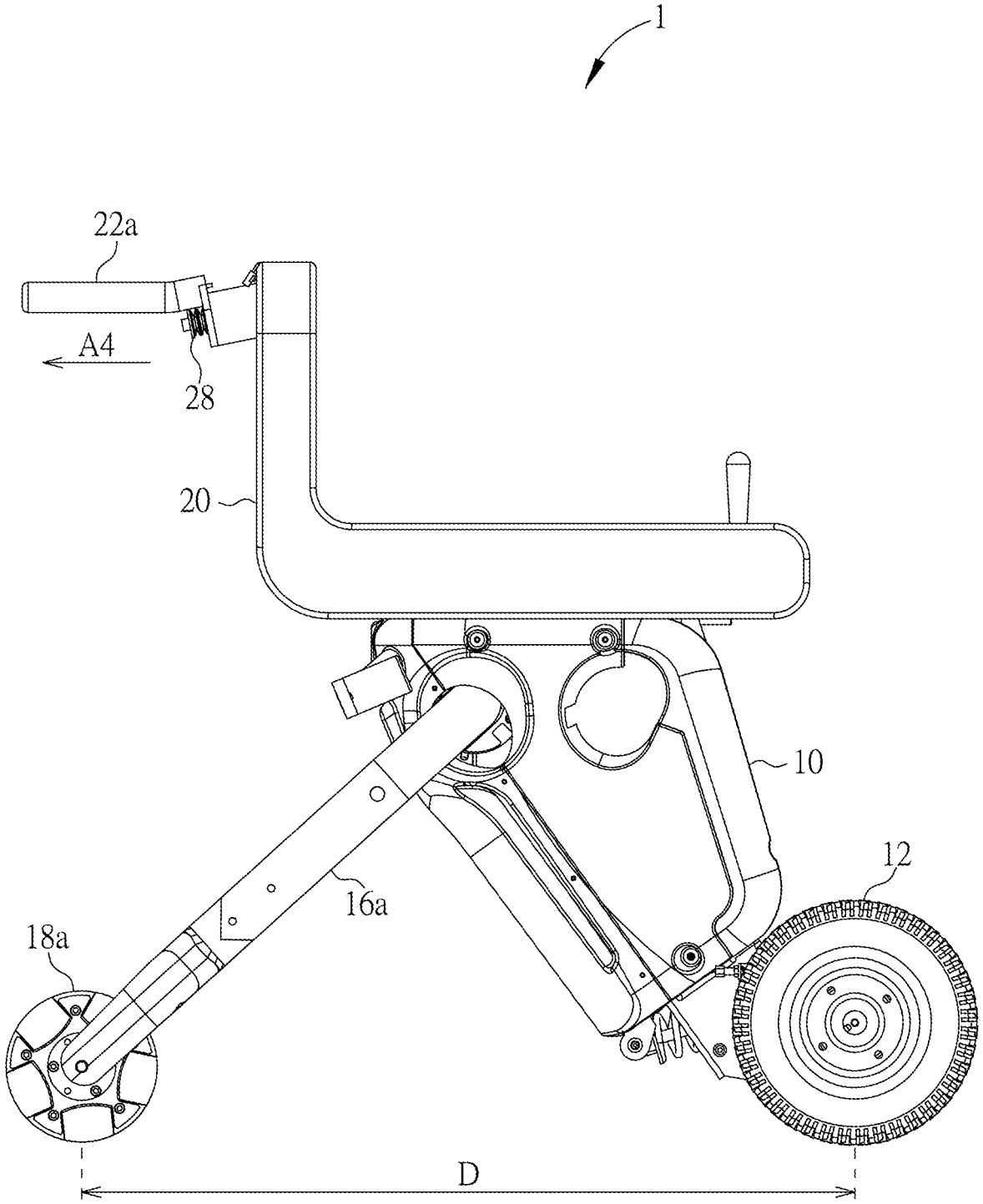
FIG. 19 is a side view illustrating the first handle shown in FIG. 18 after rotation.

Referring to FIGS. 18 and 19, when the first wheel 12 and the second wheel 18*a* are close to each other (as shown in FIG. 18), the first handle 22*a* extends along the third direction A3; and when the first wheel 12 and the second wheel 18*a* are away from each other (as shown in FIG. 19), the first handle 22*a* extends along the fourth direction A4, wherein the third direction A3 is parallel to the fourth direction A4. For further illustration, according to the embodiments shown in FIGS. 1-2 and 18-19, the disclosure may change an angle of the first handle 22*a* to change an extending direction of the first handle 22*a* in different usage states. It should be noted that the angle of the aforesaid second handle 22*b* may also be designed according to the angle of the first handle 22*a*, so it will not be depicted herein again.

Figure 20:
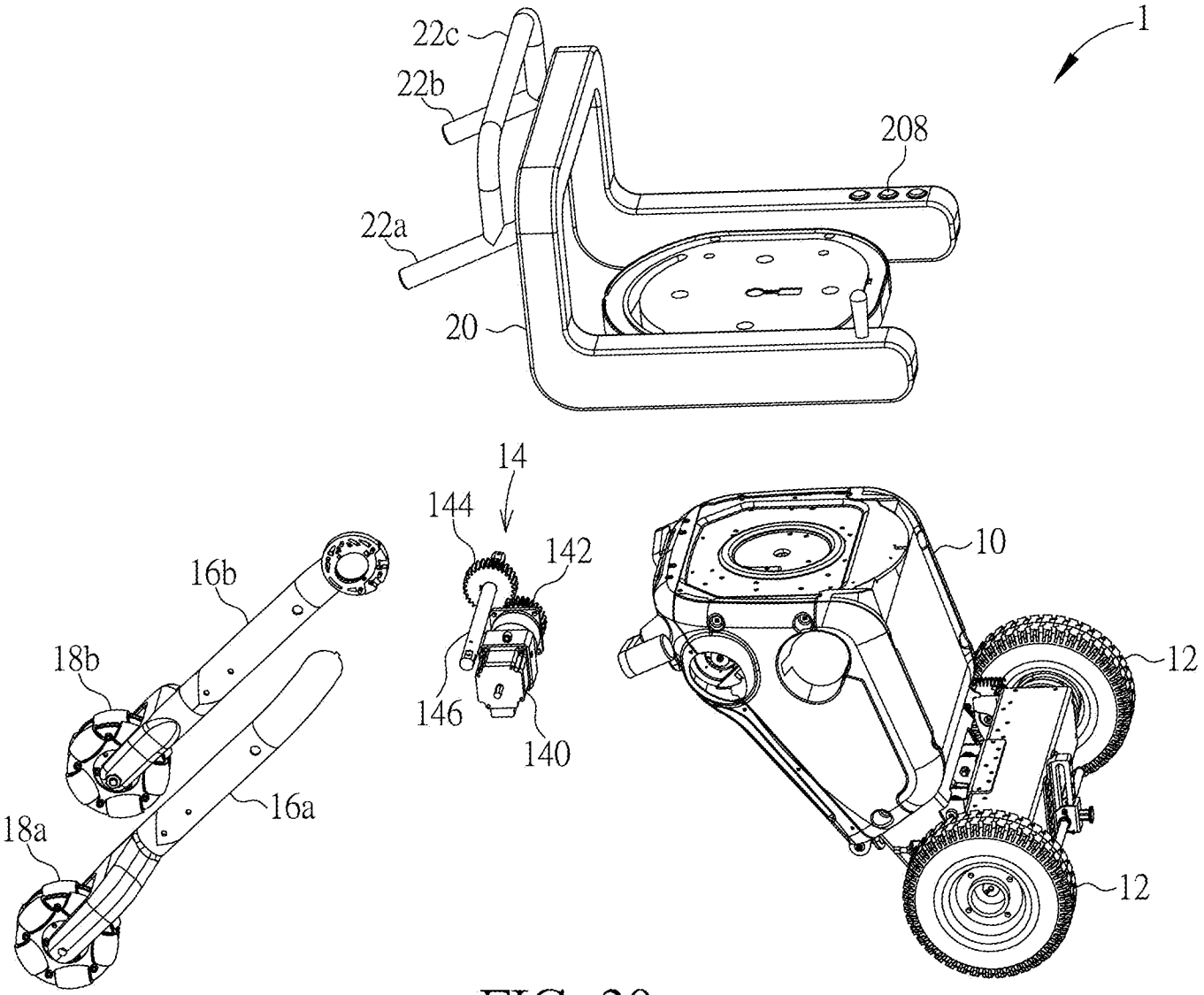
FIG. 20 is an exploded view illustrating a movable carrier according to another embodiment of the disclosure.

Referring to FIG. 20, in another embodiment of the disclosure, the first handle 22*a* and the second handle 22*b* may be connected by a third handle 22*c* and an extending direction of the third handle 22*c* is different from the extending directions of the first handle 22*a* and the second handle 22*b*, so as to provide different heights appropriate for the user to grab. In this embodiment, the first handle 22*a* and the second handle 22*b* are fixed on the seat 20 and cannot rotate. Accordingly, a plurality of buttons 208 may be disposed at an appropriate position of the seat 20. When the user presses the button 208, the driving module 14 may drive the first support member 16*a* and/or the second support member 16*b* to rotate with respect to the main body 10, so as to increase the distance between the first wheel 12 and the second wheel 18*a* and the distance between the first wheel 12 and the third wheel 18*c*, or to decrease the distance between the first wheel 12 and the second wheel 18*a* and the distance between the first wheel 12 and the third wheel 18*c*.

As mentioned in the above, a user can rotate the handle or press the button to decrease the distance between the wheels, such that the movable carrier can move within a narrow space by a small rotation radius. Furthermore, the user can rotate the handle or press the button to increase the distance between the wheels, so as to improve stability during the movement of the movable carrier. In other words, the user can rotate the handle or press the button to change the distance between the wheels, such that the movable carrier of the disclosure can satisfy different usage requirements.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A movable carrier comprising:

a main body;

a first wheel pivotally connected to the main body;

a driving module disposed in the main body;

a first support member connected to the driving module;

a second wheel pivotally connected to the first support member;

a seat disposed on the main body;

a first handle pivotally connected to the seat, the first handle having a trigger portion; and two first switches disposed on the seat and located within a rotation range of the first handle;

wherein when the first handle rotates with respect to the seat and the trigger portion triggers one of the first switches, the driving module drives the first support member to rotate with respect to the main body along a first direction, so as to increase a distance between the first wheel and the second wheel; when the first handle rotates with respect to the seat and the trigger portion triggers another one of the first switches, the driving module drives the first support member to rotate with respect to the main body along a second direction, so as to decrease the distance between the first wheel and the second wheel; the first direction is opposite to the second direction.

2. The movable carrier of claim 1, wherein the driving module comprises a first motor, a first gear, a second gear and a link rod, the first gear is connected to the first motor, the second gear is disposed on the link rod, the first gear meshes with the second gear, the first support member is connected to the link rod, and the first motor drives the first support member to rotate with respect to the main body through the first gear, the second gear and the link rod.

3. The movable carrier of claim 2, wherein the driving module further comprises a stop member, the stop member is disposed on the link rod, the first support member has a stop portion, and the stop member stops the stop portion after the driving module drives the first support member to rotate with respect to the main body along the first direction.

4. The movable carrier of claim 2, further comprising a second support member and a third wheel, the first support member and the second support member being connected to opposite ends of the link rod, the third wheel being pivotally connected to the second support member, the first motor driving the first support member and the second support member to rotate with respect to the main body synchronously through the first gear, the second gear and the link rod.

5. The movable carrier of claim 4, wherein the driving module further comprises a torsion spring and a first fixing member, the torsion spring and the first fixing member are disposed on the link rod, and opposite ends of the torsion spring are connected to the first fixing member and the second support member.

6. The movable carrier of claim 2, wherein the driving module further comprises an electromagnetic brake connected to the first motor.

7. The movable carrier of claim 1, further comprising a second handle and a transmission mechanism, the second handle being pivotally connected to the seat, the transmission mechanism being disposed in the seat and connected to the first handle and the second handle; when one of the first handle and the second handle rotates, the transmission mechanism drives the other one of the first handle and the second handle to rotate synchronously.

8. The movable carrier of claim 7, wherein the transmission mechanism comprises a plurality of gears, the gears meshes with each other, and the first handle and the second handle are connected to two of the gears.

9. The movable carrier of claim 7, wherein the transmission mechanism comprises a belt and two pulleys, the pulleys are connected to the first handle and the second handle, and the belt is connected to the pulleys.

10. The movable carrier of claim 1, wherein the first handle is pivotally connected to the seat by a hinge.

11. The movable carrier of claim 10, wherein the hinge comprises a disk spring, a plate member and a fixing member, the disk spring is sandwiched in between the plate member and the first handle, and the fixing member passes through the plate member, the disk spring and the first handle to be connected to the seat.

12. The movable carrier of claim 10, wherein the first handle has a plurality of positioning recesses, the seat has a plurality of accommodating recesses, a plurality of first elastic members and a plurality of positioning members, the first elastic member and the positioning member are disposed in the accommodating recess, opposite ends of the first elastic member abut against a bottom of the accommodating recess and the positioning member, and the positioning member engages with the positioning recess, so as to keep the first handle motionless with respect to the seat.

13. The movable carrier of claim 1, further comprising a lock module, the lock module comprising a second motor, a cam, a lock member and a second fixing member, the cam being connected to the second motor, the lock member being pivotally connected to the second fixing member, the first support member comprising two lock recesses; the second motor driving the cam to rotate and the cam driving the lock member to rotate, such that the lock member disengages from or engages with one of the lock recesses.

14. The movable carrier of claim 13, wherein the lock module further comprises a second elastic member and opposite ends of the second elastic member are connected to the lock member and the second fixing member.

15. The movable carrier of claim 13, wherein the lock module further comprises a second switch, the second switch is disposed corresponding to the lock member, the first support member comprises two third switches, the third switches are disposed in the lock recesses; when the lock member disengages from the lock recess and triggers the second switch, the driving module drives the first support member to rotate with respect to the main body; when the lock member engages with the lock recess and triggers the third switch, the driving module stops.

16. The movable carrier of claim 1, wherein when the first wheel and the second wheel are close to each other, the first handle extends along a third direction; when the first wheel and the second wheel are away from each other, the first handle extends along a fourth direction; the third direction is parallel or perpendicular to the fourth direction.

* * * * *